United States Patent [19]

Koebbeman

[11] 3,998,032

[45] Dec. 21, 1976

[54] BOTTLE CAP CRIMPER

[76] Inventor: Richard J. Koebbeman, c/o The Kebby Co., 4910 Kilburn Ave., Rockford, Ill. 61103

[22] Filed: Mar. 4, 1976

[21] Appl. No.: 663,982

[52] U.S. Cl. ..... 53/352; 53/351; 53/363

[51] Int. Cl.[2] ..... B65B 7/28; B67B 3/14

[58] Field of Search ..... 53/351, 352, 353, 363, 53/364, 331, 356, 390, 329; 81/3.1 R, 3.2

[56] References Cited

UNITED STATES PATENTS

| | | | |
|---|---|---|---|
| 946,138 | 1/1910 | Kirkegaard | 53/351 |
| 1,141,267 | 6/1915 | Ray et al. | 53/351 |
| 1,305,752 | 6/1919 | Stone | 53/351 |
| 1,954,737 | 4/1934 | Kowal | 53/351 |
| 2,087,251 | 7/1937 | Gough | 53/351 |
| 2,643,805 | 6/1953 | Muller-Strobel | 53/351 |
| 3,672,121 | 6/1972 | Kawaminani | 53/351 |

*Primary Examiner*—Travis S. McGehee
*Assistant Examiner*—Horace M. Culver
*Attorney, Agent, or Firm*—Leydig, Voit, Osann, Mayer & Holt, Ltd.

[57] ABSTRACT

A hand-held tool for crimping a cap on a bottle includes a handle with a lever member pivotally connected to one end thereof to move a plunger between advanced and retracted positions within a housing depending from the handle. Within the housing are a plurality of die segments for gripping around the neck of the bottle to crimp the lower edge of the cap beneath the lip of the bottle when the plunger is moved into its advanced position. Telescoped on the upper end portion of the plunger is a coil spring whose upper end urges against an annular shoulder formed around the upper end portion of the plunger and whose lower end engages a circular disk and urges the disk downwardly on the plunger. An annular skirt depends from the disk and includes an inner, generally frustoconical wall surface mating with a similarly shaped outer surface formed on the upper end portions of the die segments. Secured to the lower end of the plunger is an enlarged head and a free sliding collar is telescoped onto the rod between the disk and the head. The collar extends radially outward from the plunger and extends into an annular groove formed within the inner wall of the segments. A spring ring telescoped over the enlarged head seats within an annular recess formed in the die segments below the groove and urges the segments radially away from each other into a normally open position. The lower end portions of the segments are curled radially inward and include curved inner and outer wall surfaces. The outer wall surface is a cam surface which is adapted to ride across a second cam surface defining the lower opening of the housing thereby closing the die segments. Once the die segments are closed, continued downward movement of the plunger presses against the cap and causes the inner wall surface to engage the lower edge of the cap, thereby bending the latter inwardly beneath the lip of the bottle to secure the cap on the bottle. In a modified form of the invention, with the die segments closed, an acute included angle measured between the inner frustoconical wall surface of the disk and the axis of the plunger is greater than the corresponding included angle measured between the axis of the plunger and the outer frustoconical wall surface of the die segments. When the lever member is released, the coil spring urges the disk downwardly relative to the die segments so that the inner frustoconical wall surface cams against the outer wall surface of the die segments to spread the segments.

24 Claims, 6 Drawing Figures

BOTTLE CAP CRIMPER

BACKGROUND OF THE INVENTION

This invention relates to a hand-held crimper for securing a cap on a bottle, such as a vial containing a medicant, and, more particularly, to a crimper of the type employing a plurality of radially disposed jaws or die segments and a reciprocable plunger movable between the segments when closed to crimp the cap on the bottle. In one crimper of this type, the die segments are located within a housing attached to a handle. A lever member secured to one end of the handle is pivotal toward and away from the handle to reciprocate a plunger within the housing. As the plunger is slid downwardly between the die segments, the lower edge portion of the cap is folded beneath a lip formed around the opening in the neck of the bottle and thus secured to the bottle.

One crimper of the foregoing type is disclosed in U.S. Pat. No. 2,643,805.

SUMMARY OF THE INVENTION

The primary object of the present invention is to provide a new and improved hand-held crimper of the foregoing general character which is of simpler construction, is easier to use and more reliably seals the cap on the bottle.

Another important object of the present invention is to construct the crimper in a unique fashion so that it may be made less expensively with fewer precisely machined parts than prior similar crimpers while still providing easy in service use and reliable sealing. A more detailed object is to achieve the foregoing by constructing the coacting parts of the crimper to interfit in a novel manner whereby a tight seal between the cap and the bottle is formed during crimping regardless of wide tolerance variations in the sizes of the working parts of the crimper.

A still further object is to construct the crimper so that the segments close more easily around the neck of the bottle and are kept from jamming in a closed position when crimping.

The invention also resides in the novel construction of the parts of the crimper to compensate for tolerance variations between the parts without a loss in ease and reliability of operation of the crimper and in the novel manner of mounting the die segments for both pivotal and sliding movement relative to the plunger.

These and other objects and advantages of the present invention will become more apparent from the following detailed description when taken in conjunction with the accompanying drawings.

DETAILED DESCRIPTION OF THE PREFERRED EMBODIMENTS

Figure 2:
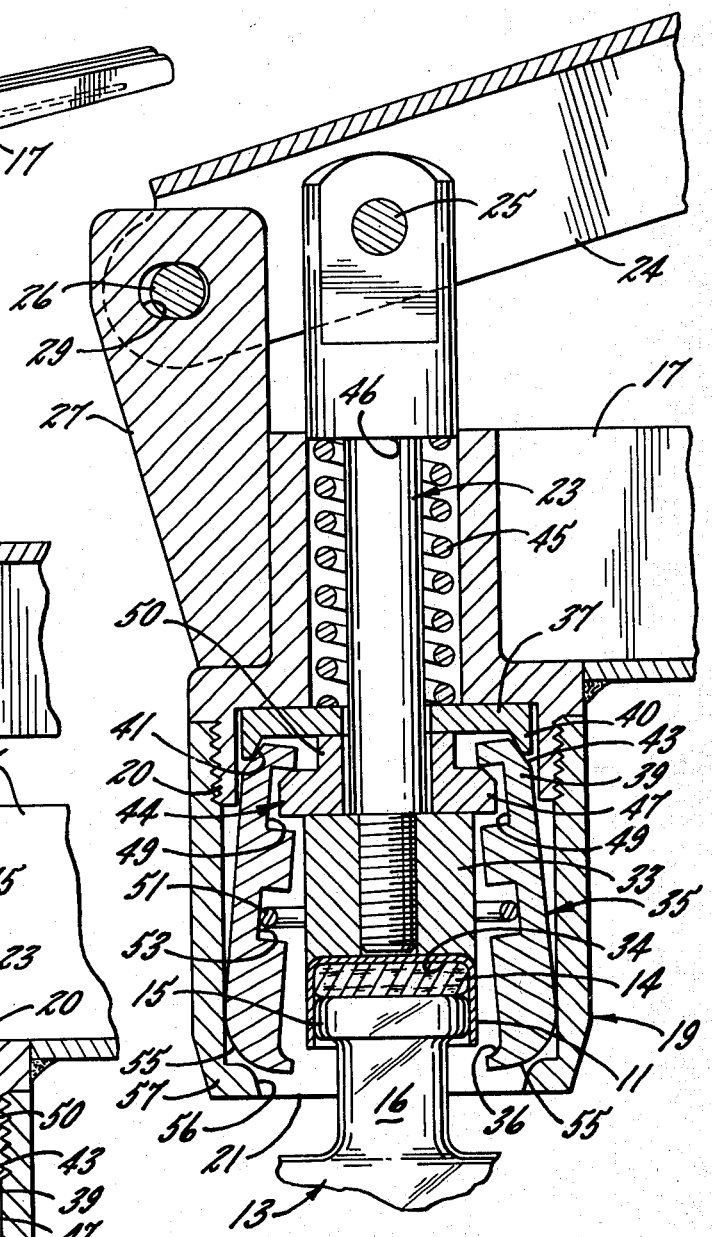
FIG. 2 is an enlarged, cross-sectional view taken substantially along line 2—2 of FIG. 1.

As shown in the drawings for purposes of illustration the present invention is embodied in a hand-held tool or crimper 10 particularly adapted for crimping a cap 11 on the top of a small bottle such as a vial 13 containing a liquid medicant. To seal the medicant in the bottle, a sealing member such as a resilient stopper 14 with an enlarged head is inserted into the vial with the head extending radially outward across the upper side of a lip 15 formed integrally with a narrower neck 16 of the bottle. The cap fits over the top of the stopper with the sides of the cap extending downwardly beyond the underside of the lip as is shown in FIG. 2. The cap is crimped on the bottle by pressing downwardly on the top of the cap to compress the head of the stopper while, at the same time, bending the lower edge of the cap radially inwardly beneath the underside of the lip. In this way, the opening in the bottle is sealed closed by the stopper while the stopper also is captivated against coming out of the bottle.

Figure 1:
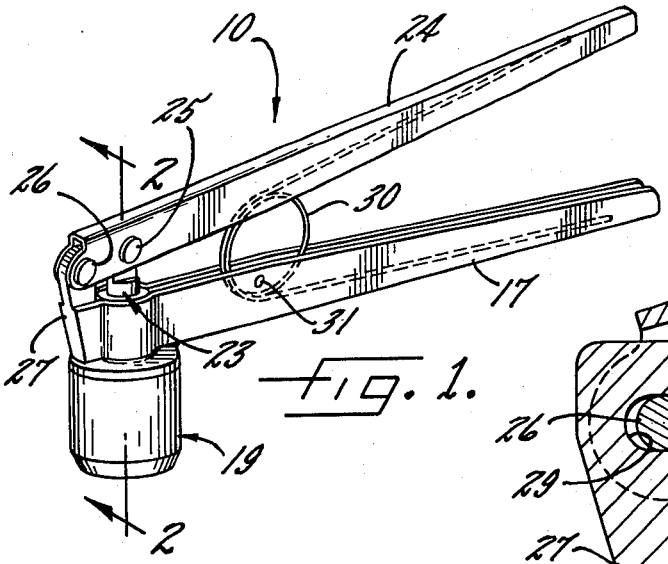
FIG. 1 is a perspective view of a hand-held, bottle cap crimper embodying the novel features of the present invention.

With reference to FIG. 1, one form of the exemplary crimper 10 is shown to include an elongated handle 17 having a cylindrical housing 19 secured to the forward end thereof. Herein, the upper end portion of the housing is internally threaded and mates with an externally threaded annular section 20 depending from the underside of the handle. The housing extends downwardly from the handle and is provided with a lower opening 21 which enables the upper end portion of the bottle to be inserted into the housing. For the cap to be crimped on the bottle, a reciprocable plunger 23 is telescoped into the housing and extends upwardly through the housing with the upper end of the plunger being connected pivotally with an elongated lever member 24 by a pin 25. The lever member extends along the upper side of the handle with the forward end of the lever being pivotally connected by another pin 26 to an upstanding bracket 27 integrally formed with the forward end of the handle. A slightly elongated hole 29 in the bracket receives the lever-mounting pin 26 so that, as the lever is moved toward and away from the handle to reciprocate the plunger, the latter slides vertically within the housing between retracted and advanced positions.

In the form of the invention illustrated in FIGS. 1 through 4, a spring 30 connected between the handle 17 and the lever member 24 is captivated by a lug 31 in the handle and acts between the handle and the lever to urge the lever away from the handle. Thus, the plunger 23 normally is held in its retracted position.

For crimping the cap 11 on the bottle 13, an enlarged head 33 is threadably secured on the lower end of the plunger 23 and includes a suitably recessed underside 34 conforming to the shape of the top of the cap. Pivotally connected to the lower end portion of the plunger above the head are several die segments 35, herein four, arranged concentrically with the plunger to move between open (see FIG. 2) and closed positions (see FIG. 3) for gripping around the cap during crimping. The lower end portions 36 of the die segments are curled radially inwardly, conforming to the shape of the underside of the lip 15 so as to fit beneath the lip of the bottle and provide a reaction surface for bending the lower edge of the cap beneath the lip as the plunger head presses downwardly on the cap.

In accordance with the primary aspect of the present invention, the crimper 10 is more simply constructed, making it easier to use and so that, in use, it more reliably seals the cap 11 on the bottle 13. For these purposes, unique means connect the upper end portions of the die segments 35 both pivotally and slidably with the plunger 23 in a way so that, as the plunger is moved toward its advanced position from its retracted position, the segments are carried with and closed around the plunger during initial movement of the plunger from its retracted position. Then, with further movement, the plunger slides with respect to the die segments and presses downwardly on the cap to cause the lower edge of the cap to be crimped radially inwardly beneath the underside of the lip 15 of the bottle. By virtue of constructing the crimper to function in this fashion, fewer precisely machined parts are required in the crimper and the crimper is easier to operate. Moreover, the crimper is more reliable in service use to seal caps on the bottles regardless of slight variations in the sizes of the caps and the bottles which otherwise tend to effect the seal between the stopper 14 and the bottle.

In the present instance, the means connecting the die segments 35 both pivotally and slidably with the plunger 23 include a circular disk 37 telescoped slidably onto the plunger between the head 33 and the upper end 39 of the plunger. Herein, the disk is of a diameter approximately equal to the diameter of the cylinder defined by the closed die segments and includes a depending peripheral skirt 40 engaging the upper end portions of the segments. Advantageously, the inner wall surface 41 of the skirt is generally frustoconical in shape and engages similarly shaped outer wall surfaces 43 formed on the outside of the die segments. The skirt holds the upper end portions of the die segments from spreading radially away from each other when the segments are closed and, by virtue of being frustoconical in shape, the mating inner and outer surfaces 41 and 43 on the skirt and die segments, respectively, need not be machined precisely. This is because with such a shape the skirt and the die segments can slide slightly in a generally axial direction relative to each other in order for the skirt to achieve the proper position for holding the upper end portions of the die segments against expanding when the lower end portions of the die segments are closed for crimping.

In the form of the invention illustrated in FIGS. 1 through 4, the frustoconical inner and outer wall surfaces 41 and 43 of the disk 37 and of the die segments 35, respectively, are slanted upwardly and radially inward at the same acute angle (approximately thirty-five degrees) with respect to the central axis of the plunger 23 when the die segments are closed. When the die segments are in their open positions, however, the acute angle which the outer surfaces 43 of the die segment make with respect to the axis is greater than the acute angle that the frustoconical inner surface 41 makes with respect to the axis.

Figure 3:
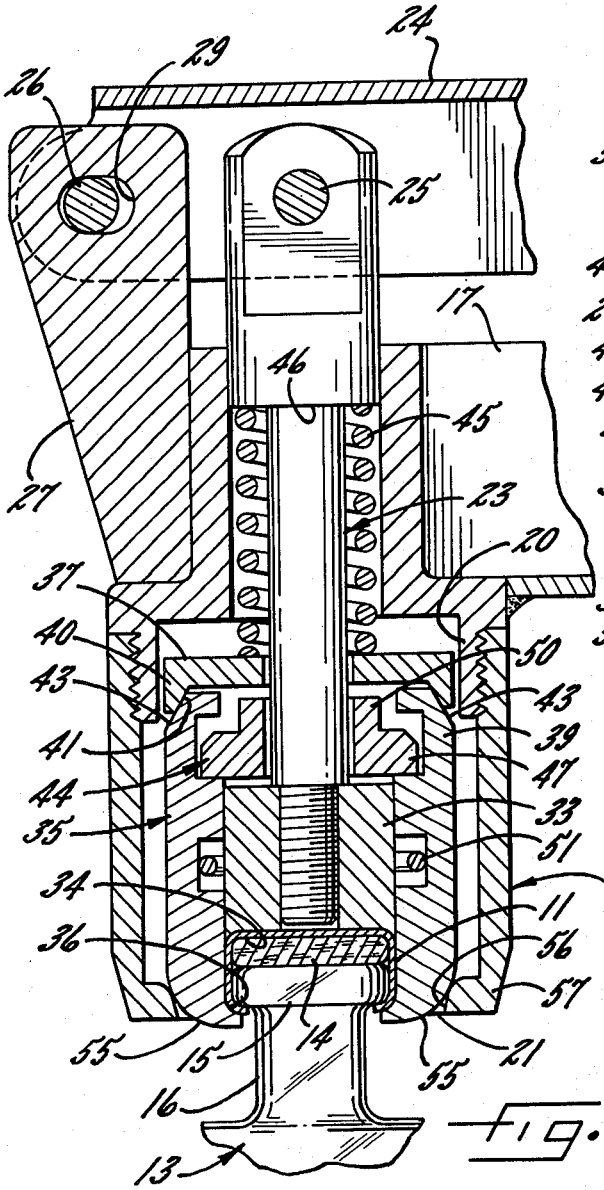
FIG. 3 is a view similar to FIG. 2 but showing parts of the crimper in moved positions.
Figure 4:
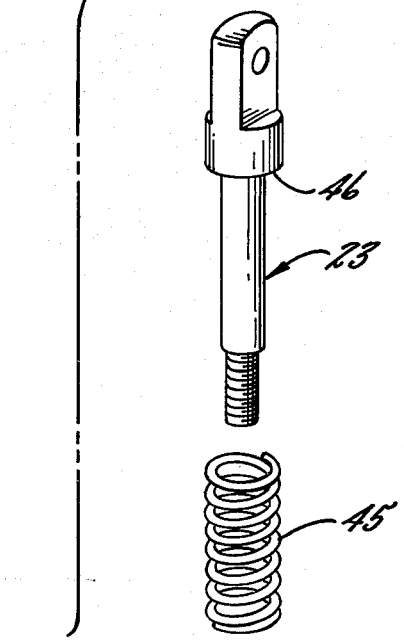
FIG. 4 is an exploded perspective view of parts of the crimper.
Figure 4:
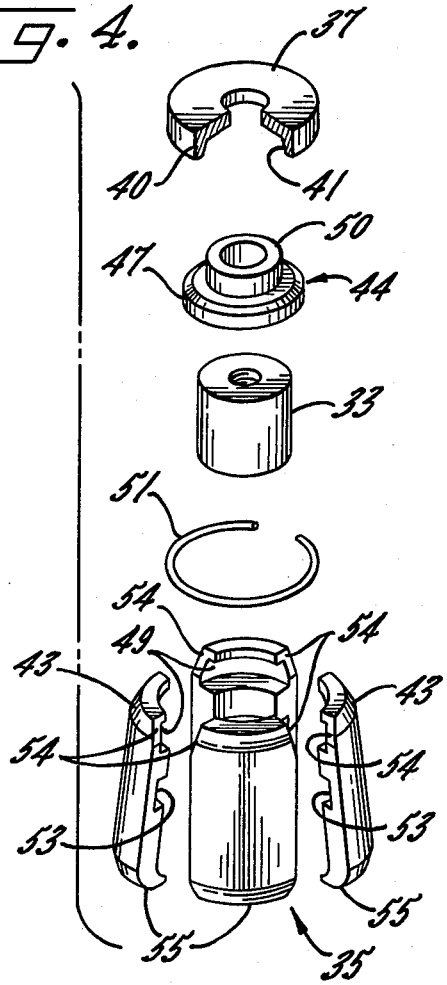

Coacting with the disk 37 to hold the die segments 35 pivotally and slidably on the plunger 23 is a retaining collar 44 and a coil spring 45. Herein, the collar is slidably mounted on the plunger between the disk and the head 33 and the coil spring is telescoped onto the plunger above the disk. The spring acts between the disk and an annular shoulder 46 formed in the upper end portion of the plunger to urge the disk toward the head 33. More particularly, as shown in FIGS. 2 and 3, the collar 44 includes a lower annular flange 47 extending radially outward beyond the head to fit within an annular groove defined by groove segments 49 formed in the inside surfaces of the die segments adjacent their upper ends. In the open positions of the die segments, the spring urges the disk against the upper end 50 of the collar thereby forcing the collar against the head and the upper ends of the die segments are captivated in the space between the flange 47 and the skirt 40.

Urging the die segments 35 into their open positions when the plunger 23 is retracted is a ring spring 51. As shown in FIG. 2, the spring ring is mounted within an annular recess 53 formed in the die segments intermediate the upper and lower ends of the segments and closer to the lower ends of the segments. Accordingly, when the plunger is in its retracted position, the spring 51 urges the die segments radially away from each other with the upper end portions of the die segments pivoting on the flange 47.

In order for the spring 51 to pivot the segments 35 into their open positions without having to overcome the coil spring 45, the upper end portions of the die segments are narrower than their lower end portions. As may be seen in FIG. 4, the opposite sides of the upper end portions of the die segments are provided with chamfered surfaces 54 slanting toward each other upon progressing upwardly toward the upper ends of the segments. In this way the die segments are free to pivot without the adjacent corners of the die segments binding against each other.

For ease in closing the die segments 35 as the plunger 23 is moved from its retracted position into its advanced position, a further advantage of the present invention resides in the provision of cam means on the die segments and in the housing 19 with the cam means being located so as to force the die segments closed around the cap 11 from a position disposed radially from the cap rather than from a position above the cap so as to avoid jamming due to overcentering of the die segments into their closed positions. To this end, first cam surfaces 55 are formed on the lower end portions of the die segments and a second cam surface 56 defines the opening 21 in the lower end of the housing 19. More particularly, the first cam surface on each die segment is a convex curved portion of the outside wall of the lower end portion of the die segment and the second cam surface is of an inverted generally frustoconical shape so that the opening becomes increasingly narrower upon progressing downwardly from the interior of the housing. More particularly, the second cam surface 56 defines the radially inward wall of an annular flange 57 projecting radially inwardly from the lower end of the housing.

In operation of the crimper 10, the lever member 24 is pivoted toward the handle 17 to force the plunger 23 downwardly from its retracted position in the housing 19 and toward its advanced position. As the plunger initially slides downwardly within the housing, the disk 37, retaining collar 44 and die segments 35 are carried with the plunger, the disk, collar and segments being urged together by the spring 45. As the die segments slide downwardly, the first cam surfaces 55 engage the second cam surface 56 and the lower end portions of the die segments are cammed radially inwardly into their closed positions around the cap 11 while the upper end portions of the segments pivot radially outward until the frustoconical surfaces 41 and 43 nest flat against each other. Once the die segments are closed around the cap, continued pivoting of the lever toward the handle causes the plunger to slide axially downward relative to the die segments to force the cap, in turn, downwardly between the die segments and cause the lower edge of the cap to be bent inwardly beneath the underside of the lip 15 thereby crimping the cap on the bottle 19.

Figure 5:
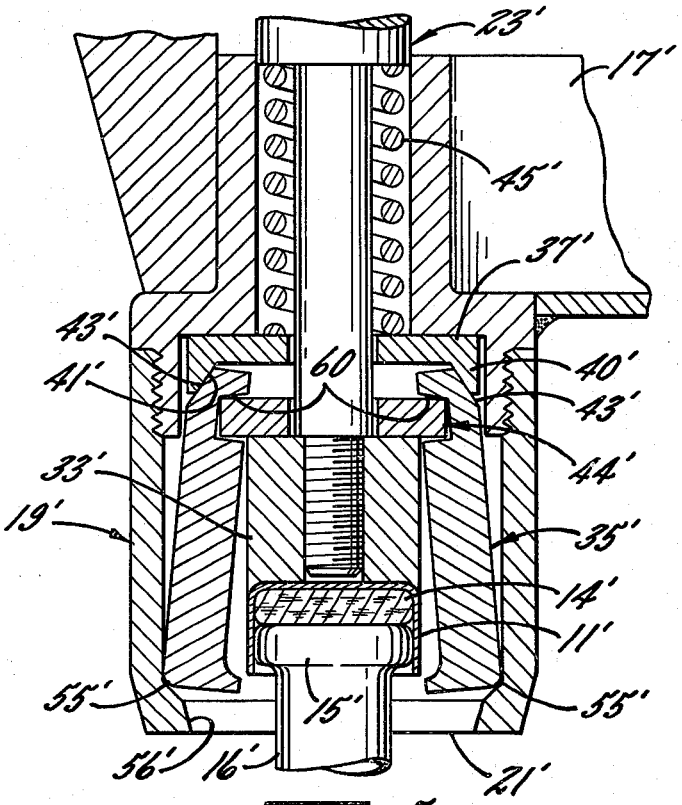
FIG. 5 is a fragmentary, cross-sectional view similar to FIG. 2 but showing an alternative embodiment of the invention.
Figure 6:
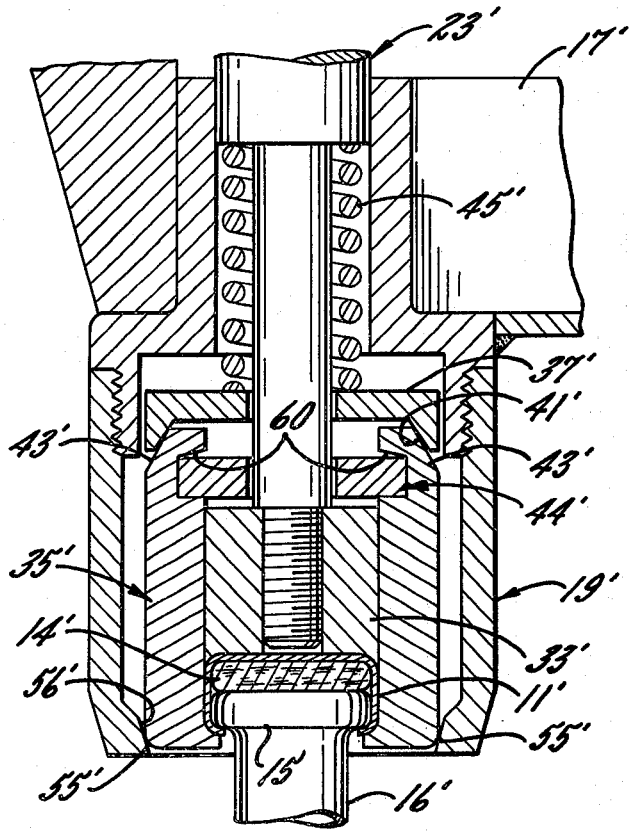
FIG. 6 is a view similar to FIG. 5 but showing parts of the alternative embodiment in moved positions.

A second form of the present invention is illustrated in FIGS. 5 and 6 wherein parts corresponding to the first form of the invention are identified by the same but primed reference numbers. Advantageously, in the second form of the invention, certain parts of the crimper 10' are shaped slightly different from those of the first crimper so as to utilize the spring 45' to urge the die segments 35' into their open positions when the plunger 23' is in its retracted position. As shown in FIG. 5, the frustoconical surfaces 41' and 43' of the disk 37' and die segments 35' are formed so as to assume the same acute included angle with respect to the axis of the plunger 23' when the plunger is retracted. When the plunger is in its advanced position, however, the acute angle defined between the frustoconical surface 43' and the axis of the plunger is less than the corresponding angle defined between the plunger axis and the frustoconical surface 41' by about 5°. In addition, an upper wall 60 of the groove segment 49' in each of the die segments is slanted slightly upwardly (at about ten degrees relative to a radial line from said plunger) upon progressing radially inwardly from the radially outward end of the groove segment. By virtue of this arrangement, the urging of the spring 45' against the disk 37' causes the frustoconical surface 41' to cam against the surfaces 43' of the die segments and thereby pivot the segments into their open positions when the plunger 23' is retracted under the urging of the coil spring 45'.

Thus, it is seen from the foregoing that the crimper 10 of the present invention is constructed in a unique fashion greatly simplifying the overall construction of the crimper while also providing a crimper which not only is easier to use but also is more reliable in service use than prior crimpers of a similar general character. In achieving these ends, the die segments 35 of the crimper are mounted in a unique fashion so as to first pivot closed around the cap 11 to be crimped on the bottle 13 and then to slide with respect to the plunger as the plunger is moved from its retracted position and into its advanced position. Moreover, cam means for closing the die segments are located advantageously on the die segments and within the housing adjacent the opening 21 so as to assure a secure grip around the cap to assure proper sealing during crimping.

I claim:

1. A hand-held tool for crimping a cap on the top of a bottle including a handle, a housing having one end connected to said handle and an opening in the opposite end thereof, a plunger telescoped into said housing, means connected with said plunger for sliding the plunger axially within said housing from a normally retracted position into an advanced position, a plurality of die segments disposed within said housing around said plunger for pivotal movement between open and closed positions relative to said plunger, means for connecting the upper end portions of said segments pivotally and slidably with said plunger and means for closing said segments around said plunger prior to said plunger sliding relative to said segments so that said segments are carried in an axial direction with said plunger and are pivoted closed around said plunger as the latter initially is moved from its retracted position toward its advanced position with said plunger thereafter sliding axially with respect to said segments so as to crimp the cap on the top of the bottle as said plunger reaches its advanced position.

2. A hand-held tool for crimping a cap on the top of a bottle including an elongated handle, a lever member having one end pivotally connected with said handle, a generally cylindrical housing having one end connected to said handle and an opening in the opposite end thereof for admitting the top of the bottle into said housing, a plunger having an upper end portion connected to said lever member and a lower end portion extending through said handle and into said housing for axial movement within said housing from a retracted position into an advanced position as said lever member is pivoted toward said handle, an enlarged head on the lower end of said plunger, a collar slidably mounted on said plunger between the upper end thereof and said head, a disk telescoped on said plunger between the upper end thereof and said collar, a spring acting against said disk and urging the latter toward said collar, a plurality of die segments having upper end portions captivated between said disk and said collar for pivotal movement of said segments between open and closed positions around the top of the bottle received within said housing, first cam surfaces on said die segments, and a second cam surface within said housing adjacent said opening for engagement with said first cam surfaces so that, as said segments are carried with said plunger toward said advanced position, said die segments are cammed toward their closed positions for coacting with said head to crimp the cap on the bottle as said plunger slides relative to said segments upon moving further toward its advanced position once said die segments are closed.

3. A hand-held tool as defined by claim 2 wherein each of said die segments includes a groove segment formed in the upper end portion thereof and opening generally toward said plunger, said groove segments defining an annular groove and said collar having a diameter greater than the diameter of said head and extending radially into said annular groove, said disk having a diameter greater than the outside diameter of said die segments in their closed positions, and including a depending annular skirt integrally formed with said disk and extending axially along the outer surfaces of said die segments so as to captivate said segments pivotally on said plunger.

4. A hand-held tool as defined by claim 3 wherein said skirt includes a frustoconical inner surface, said die segments each having an outer wall surface formed in the upper end portion thereof, said outer wall surfaces defining an outer frustoconical surface telescoped with and engaging said inner frustoconical surface.

5. A hand-held tool as defined by claim 4 including a curved, outer wall portion defining the lower end portion of each of said die segments and serving as said first cam surface.

6. A hand-held tool as defined by claim 5 wherein said curved outer wall portions are curved convexly outward.

7. A hand-held tool as defined by claim 5 including an annular flange integrally formed with said housing and extending radially inward thereof so as to define said opening, said flange having an inside wall surface slanting radially outward upon progressing upwardly from the lower end of said housing and serving as said second cam surface.

8. A hand-held tool as defined by claim 7 wherein said inside wall surface is of an inverted, generally frustoconical shape.

9. A hand-held tool as defined by claim 7 including a shoulder on said plunger extending radially therefrom adjacent the upper end thereof, said spring being a coil spring telescoped onto said plunger with one end of said spring abutting said shoulder and the other end of said spring engaging and urging said disk into engagement with said die segments.

10. A hand-held tool as defined by claim 9 wherein said inner and outer frustoconical surfaces of said disk and said segments are formed at essentially the same acute angle with respect to the axis of said plunger when said die segments are in their closed positions.

11. A hand-held tool as defined by claim 10 including an annular recess formed in the inside surface of said die segments between said annular groove and the lower ends of said segments, said recess opening radially toward said plunger, a spring ring located in said recess and urging said die segments toward their open positions.

12. A hand-held tool as defined by claim 9 with said inner frustoconical surface of said disk being formed at a first acute included angle with respect to the axis of said plunger, said outer frustoconical surface of said segments being formed at a second acute included angle with respect to the axis of said plunger, said second acute angle being smaller than said first acute angle when said die segments are in their closed positions.

13. A hand-held tool as defined by claim 12 wherein said second angle is approximately 5° smaller than said first angle.

14. A hand-held tool as defined by claim 13 wherein said first angle is approximately 35°.

15. A hand-held tool as defined by claim 12 wherein said annular flange includes a generally radial upper wall slanting slightly upward upon progressing radially inward from the outer edge of said wall when said die segments are in their closed positions.

16. A hand-held tool as defined by claim 15 wherein said radial upper wall is slanted at approximately 10° with respect to a radial line from said plunger.

17. A hand-held tool as defined by claim 9 wherein the upper end portions of said die segments are circumferentially narrower than the lower end portions of said die segments.

18. A hand-held tool for crimping a cap on the top of a bottle including an elongated handle, a lever member having one end pivotally connected with said handle, a housing having one end connected to said handle and an opening in the opposite end thereof for admitting the top of the bottle into said housing, a plunger having an upper end portion connected to said lever member and a lower end portion extending into said housing for movement within said housing from a retracted position into an advanced position as said lever member is pivoted toward said handle, a head on the lower end of said plunger, a collar slidably mounted on said plunger between the upper end thereof and said head, a disk slidably mounted on said plunger between the upper end thereof and said collar, a spring acting against said disk and urging the latter toward said collar, a plurality of die segments having upper end portions captivated between said disk and said collar for pivotal movement between open and closed positions around the top of the bottle received within said housing, and cam means on said die segments and around said opening for moving said segments into their closed positions as said segments are carried with said plunger upon progressing initially toward said advanced position.

19. A hand-held tool for crimping a cap on the top of a bottle including a handle, a housing having one end connected to said handle and an opening in the opposite end thereof, a plunger telescoped into said housing, means connected with said plunger for sliding the plunger axially within said housing from a normally retracted position into an advanced position, a plurality of die segments disposed within said housing around said plunger and having upper and lower end portions, means for connecting said upper end portions to pivot with respect to said plunger for said segments to move between open and closed positions, a disk telescoped onto said plunger intermediate the opposite ends thereof and having a depending annular skirt extending axially along the outer surfaces of said die segments for engagement with said upper end portions thereof to hold said segments against separation from each other when said die segments are closed around said plunger during crimping, and cam means on said die segments and within said housing for moving said segments into their closed positions as said plunger is moved toward its advanced position.

20. A hand-held tool as defined by claim 19 wherein said skirt includes an inner surface slanted radially inwardly upon progressing upwardly from the lower edge of said skirt, a similarly slanted outer wall surface defined by said upper end portions of said segments, said upper end portions being telescoped into said skirt with said outer wall surface engaging said inner surface.

21. A hand-held tool as defined by claim 20 wherein said outer wall surface is slanted at essentially the same angle with respect to the axis of said plunger as said inner wall, when said die segments are in their closed positions, and at a greater angle than said inner wall with respect to the axis of said plunger when said die segments are in their open positions.

22. A hand-held tool as defined by claim 20 wherein said outer wall surface is slanted at essentially the same angle as said inner wall with respect to the axis of said plunger when said die segments are in their open positions and at a lesser angle than said inner wall when said die segments are in their closed positions.

23. A hand-held tool as defined by claim 22 including a spring connected between said plunger and said disk and urging the latter into engagement with the upper end portions of said segments so as to cause said segments to be urged toward their open positions.

24. A hand-held tool as defined by claim 19 wherein said cam means includes first cam surfaces defined by curved outer wall portions defining the lower end portions of said die segments and a second cam surface defining said opening and slanting radially outward upon progressing upwardly from the lower end of said housing.

* * * * *